United States Patent [19]

Castelli

[11] 4,358,006

[45] Nov. 9, 1982

[54] RIGID SIDE ARM DEVICE FORMING A GUIDING HANDLE FOR SUITCASE

[75] Inventor: Renato Castelli, Ghent, Belgium

[73] Assignee: Samsonite Corporation, Denver, Colo.

[21] Appl. No.: 213,389

[22] Filed: Dec. 5, 1980

[30] Foreign Application Priority Data

Dec. 28, 1979 [BE] Belgium ..... 0/198799

[51] Int. Cl.[3] ..... A45C 13/28; A45C 5/14

[52] U.S. Cl. ..... 190/18 A; 190/58 B; 16/115; 280/37

[58] Field of Search ..... 190/18 A, 18 R, 57, 190/58 R, 58 B; 280/37, 38, 47.17, 47.19, 47.26; 150/1.5 B; 16/115

[56] References Cited

U.S. PATENT DOCUMENTS

| | | | |
|---|---|---|---|
| Re. 29,036 | 11/1976 | Hager | 190/18 A X |
| 2,962,138 | 11/1960 | Finkelstein | 190/57 |
| 3,805,929 | 4/1974 | Kuwayama | 190/18 A |
| 3,948,365 | 4/1976 | Gregg et al. | 190/18 A |
| 4,062,429 | 12/1977 | Tabor et al. | 190/18 A |

*Primary Examiner*—William Price
*Assistant Examiner*—Sue A. Weaver
*Attorney, Agent, or Firm*—Robert E. Burns; Emmanuel J. Lobato; Bruce L. Adams

[57] ABSTRACT

Handle device for suitcase of shell type or rigid structure type, equipped with one or more casters or rollers or indeed one or more pairs of casters or rollers, the device being composed in known manner of a fixed component, attached to the transverse side of the suitcase, and of another, opening component, that is to say an element capable of moving away from the perimeter of the suitcase and forming the handle proper, these two components being pivotally mounted with respect to each other, the first and second component are basically constituted of a straight member of channel section (U-section), the first, fixed component having a length considerably less than that of the second, opening component and the member constituting the first component being of a smaller sectional dimension than the member constituting the basic portion of the second component in such a manner as to be capable of being seated therein when the opening component is folded back, the two components being integrally connected to each other, on the one hand the one component being connected inside the other at their ends in a pivoting manner and on the other hand by a tension member forming a brace when the handle is opened, the tension member being mounted and pivotally fixed at the one end to the first component and being free at the other end but constrained to slide and held between the sides of the U-section of the second component, said tension member being forced, both before its maximum angle and before its minimum angle relative to the first, fixed component, to continue its pivoting action relative to the latter component under the effect of a spring strip which is doubly curved in such a manner as to force the opening component or handle to fold down or to maintain the open position beyond a certain minimum angle or maximum angle respectively.

9 Claims, 13 Drawing Figures

RIGID SIDE ARM DEVICE FORMING A GUIDING HANDLE FOR SUITCASE

FIELD OF THE INVENTION

This invention relates to a device forming a guiding handle for a suitcase.

Suitcases comprising a shell or rigid structure are now increasingly being fitted with one or more casters or rollers or one or more pairs of casters or rollers; to enable suitcases equipped in this manner to be easily moved and manoeuvred, it has been proposed to place at the side opposite to (or corner opposite to) said rollers, a folding arm that can be used as a guiding handle and which, moreover, where there is only one roller or one pair of rollers mounted on one corner of the suitcase, will also serve for partially lifting these suitcases.

BACKGROUND OF THE INVENTION

Handles of the type at present known exhibit the following disadvantages: they are not automatically held both in the open position (position of use) and in the closed position (folded position); to do this, one of these must be latched; moreover, the handlers are generally smooth members which can easily slide in the hand when the roller or rollers encounter an obstacle.

OBJECT OF THE INVENTION

The handle according to the present invention overcomes these disadvantages, it is automatically blocked both in the open position and in the closed position beyond a certain position, it is designed in such a way as to prevent it sliding in the hand, and moreoever its dimensions are designed for easy moving of the suitcase and, in the folded position, it fits perfectly within the contour of the suitcase.

For this purpose, the device forming a handle for a shell-type or rigid structure suitcase, according to this invention, is composed in known manner of a fixed component attached to the transverse side of the suitcase, and of another, opening component, that is to say an element capable of moving away from the periphery of the suitcase and constituting the handle proper, these two components being mounted to pivot with respect to each other, is characterized in that the first and also the second component are constituted essentially of a channel section (U-section), the first, fixed component being considerably shorter than the second, opening component and the section constituting the first component being of smaller dimensions than the section consisting the basic part of the second component in such a manner that it can nest within it when the opening component is folded down; the two components being integrally connected to each other, firstly by one component pivoting inside the other at one of their ends and secondly by a tension member forming a brace or strut when the handle is opened, this tension member being mounted and pivotally fixed at one end to the first component and free at the other end but compelled to slide and held within the sides of the channel section of the second, opening component, said tension member being forced, both just before its minimum angle and just before its maximum angle with respect to the first, fixed component to continue its pivoting movement with respect to the component under the effect of a double-bent spring strip, in such a manner as to force the opening component, that is the handle, beyond a certain minimum or maximum angle, to fold down or to remain in the open position.

Preferably, in addition, near to the free end of the second, opening component of the handle, there is provided on the inner face a lug capable of springing up under the effect of a spring when the handle opens; in addition, on the inner face, the handle comprises on the near side of this lug an imprint of four fingers in such a manner as to obtain a perfect grip on the handle.

Figure 1:
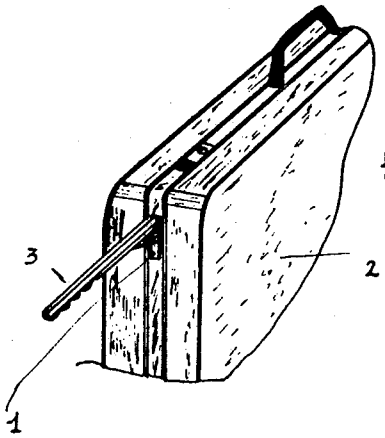
FIG. 1 is a diagrammatic general view of the handle device fixed to a suitcase.

Referring to these various figures, reference 1 denotes the first component forming a fixed member, having a channel section, and attached for example by screws to the side of a suitcase 2 (shown diagrammatically and in part only), reference 3 denotes the second, opening component, that is the handle proper, composed of a channel section 4 within which there is positioned and fixed another element 5 of shorter length than the member 4 in such a manner as to leave a free space 6 sufficiently large to permit the fixed member 1 to become seated in the opening member 4, reference 7 denotes a tension member forming a brace when the opening handle 3 is separated from the fixed member and constraining the opening and closing of the opening member 3 by means of the spring strip 8, and refeence 9 denotes a pivot axis forming the connection between the opening member 3 and the fixed member 1.

Figure 10:
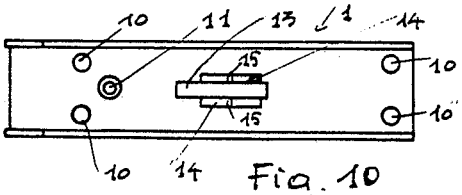
FIG. 10 is an external view (rear view) of the first, fixed component.
Figure 11:
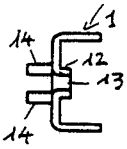
FIG. 11 is a transverse section along the line I/I of FIG. 10.

A detailed description of each of these elements will now be given below:

The fixed member 1, the first component (FIG. 10 and 11) having a straight U-section with four apertures 10 permitting the passage of screws (not illustrated) or other means for fixing the member 1 to the suitcase 2; an aperture 11 being provided to permit the fixing of the spring strip 8 for example by means of a hollow rivet (not illustrated), or indeed, as shown, by folding over the internal edges 12 (FIG. 11) of the aperture 11 after having positioned the strip spring 8 thereon. The fixed member 1 comprises also a median slit 13 which, on the outside, is equipped on either side of its longitudinal edges towards the end situated nearest to the free end of the fixed member, with a lug 14 perforated by a hole 15 for the fitting of the pivot axis 16 of the brace 7, the end of this brace passing through the slit 13.

The opening member or handle 3, the second component, is composed of two elements, a member 4 of straight channel section and another element 5 situated thereon and of shorter length, so as to leave a free space 6 to permit the fixed member 1 to become situated also therein when the handle is folded down.

Figure 2:
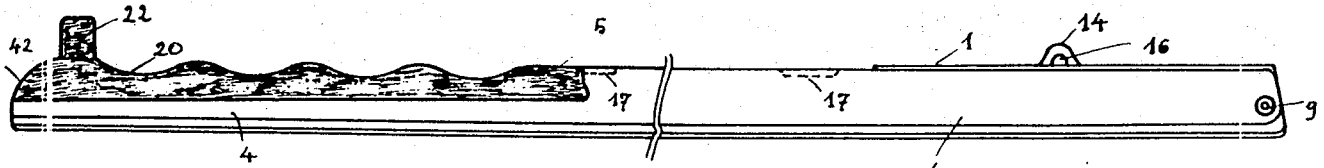
FIG. 2 is a side view of the handle device only, this being in the closed position.
Figure 3:
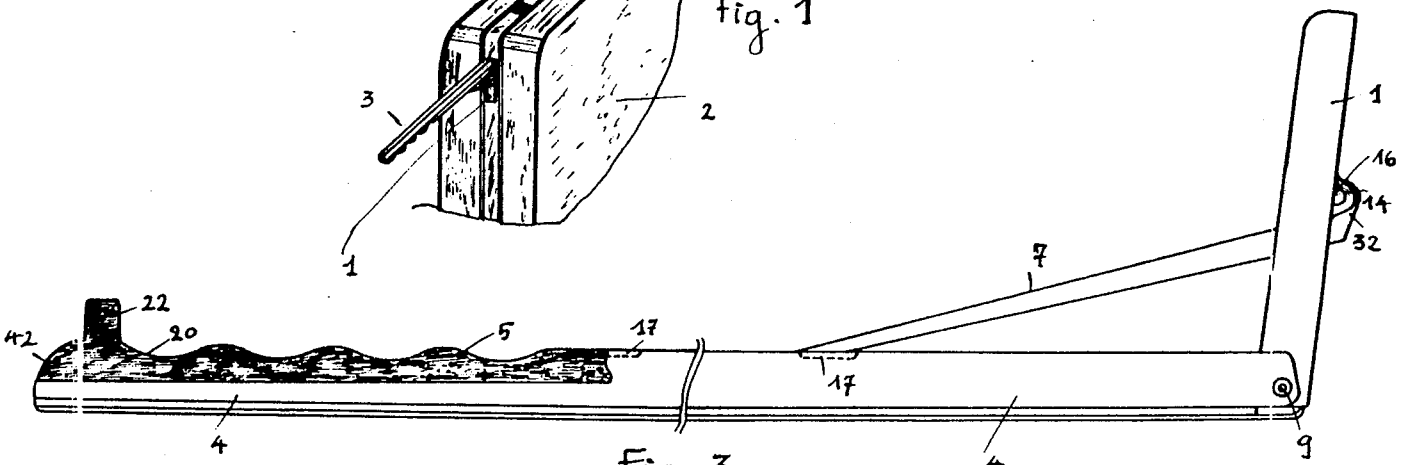
FIG. 3 is a view corresponding to FIG. 2 of the device, but with the handle in the open position.
Figure 6:
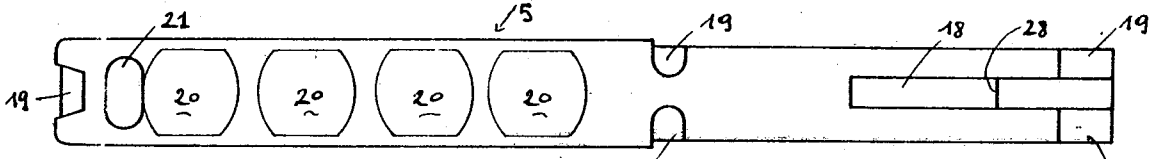
FIG. 6 is a view from above of the component positioned and held in the second component; the opening handle.
Figure 7:
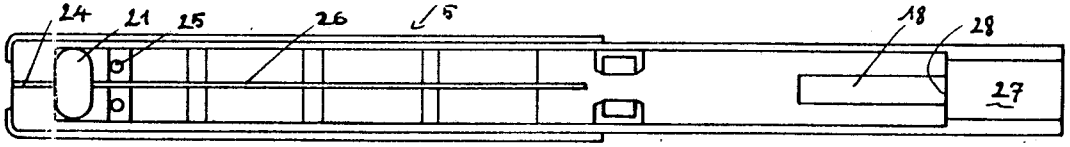
FIG. 7 is a view from below of the same component as in FIG. 6.

The member 4 (FIGS. 2 and 4) comprises in known manner bent tongues 17 which lock the element 5 in position, which element is preferably formed by moulding whereas all the other components are of metal and which internally covers the member 4; this element 5 (FIGS. 6 and 7) exhibits the following characteristics: seen from above (FIG. 6 from the outside) a slit 18 for the passage and guidance of the brace 7, various small recesses 19 into which the tongues 17 will be bent down, and also four undulations, imprints 20 for the fingers which enable the handle to be firmly held by the hand; there is also, at the end, a slit 21 for the passage of a lug 22 thrust by a spring 23 (FIG. 4) which prevents the hand from sliding; seen from the rear (FIG. 7 from the inside) portions 24, 25, 26, 27 forming a positioning base for the element 5 in the channel member 4, the end 28 of the element 27 forming a stop for the brace 7 in the bracing position and thus limiting the angle of opening of the handle.

Figure 8:
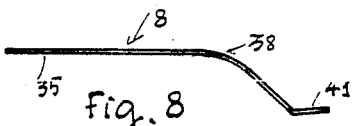
FIG. 8 is a side view of the strip spring.
Figure 9:
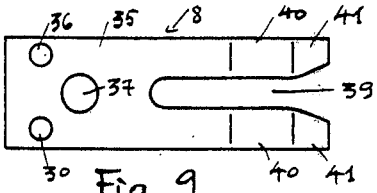
FIG. 9 is a view from above of the strip spring illustrated in FIG. 8.
Figure 12:
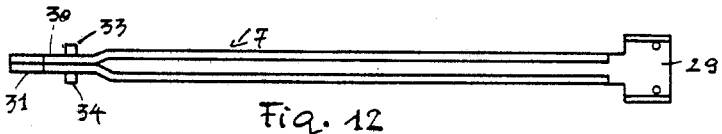
FIG. 12 is a view from below of the brace or strut.
Figure 13:
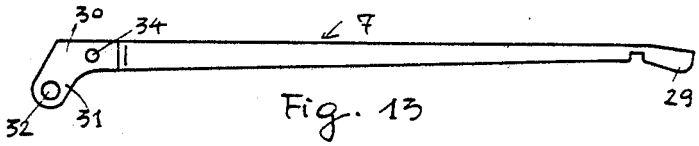
FIG. 13 is a side view of the brace or strut of FIG. 12.

Referring more particularly to FIGS. 12 and 13, it can be seen that the brace 7, an essentially straight bar except for its two ends 29 and 30, the one widened-out end 29 forming a small plate which returns slightly towards the horizontal (when the brace 7 is positioned in the opening member 3, the latter being separated from the fixed member 1) and which, when it has once been introduced through the slot 18 (by bringing it in on its side) of element 5, is subsequently held by this element while at the same time retaining the facility for sliding as far as stop 28 when the opening member is separated, and in addition this end, the plate 29, cannot separate from the opening member 3 since it is prevented from doing so by the element 5; the other thinned-out end 30 comprises a small fin 31 disposed laterally relative to the general axis of the bar, this fin 31 has an aperture 32 for the passage of a pivot axis 16 for the brace 7 to pivot on the fixed member 1, the pivot axis of the brace 7 being therefore to one side of its central axis, while on this end 30 of the brace 7 there has also been provided, on each of the longitudinal sides, a small stub 33, 34, against which there bears the spring strip 8 which serves for forcing the opening and closing of the opening member 3 relative to the fixed member 1. This spring strip 8, as can be seen in FIGS. 8 and 9, comprises a flat non-active portion 35 serving for fixing the strip to the fixed member 1 and equipped with apertures 36 opposite to two of the apertures 10 of the fixed member 1 and an aperture 37 opposite to the aperture 11 for fixing this strip to the fixed member 1. The non-active portion 35 is then continued by an active portion 38, initially flat, then curved downwards and finally curved upwards at the end, while in this portion 38 there is provided an open longitudinal slit 39 forming two tongues 40 on either side thereof; the body of the brace 7 being capable of moving in the slit 39, while each of the tongues 40 and their end portions 41 bear against the stub 33, 34 of the brace 7.

Figure 4:
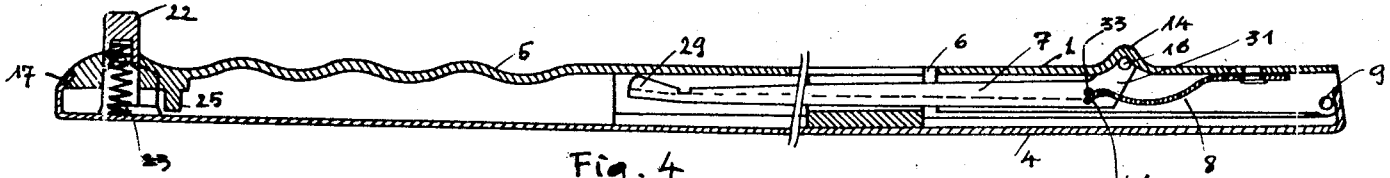
FIG. 4 is a longitudinal central section through FIG. 2.
Figure 5:
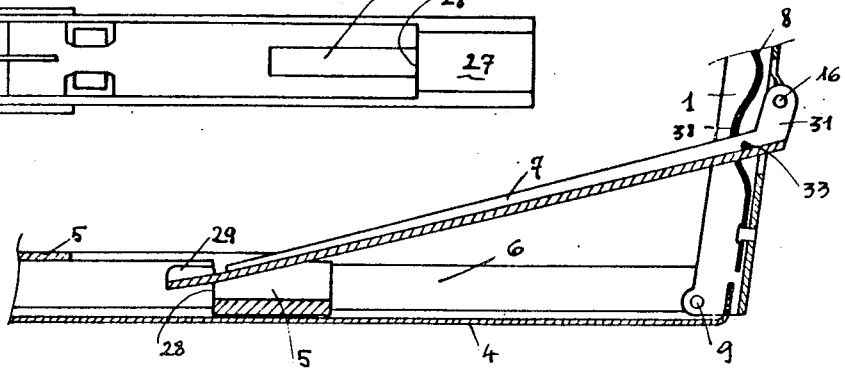
FIG. 5 is a partial longitudinal central section through FIG. 3.

When the spring strip 8 is positioned in the fixed member 1 as in FIGS. 4 and 5, it can be seen that the double curvature of the active portion 38, on one side of the curve (FIG. 5) forces the brace 7 into the bracing position and the opening member 3 into the position of maximum open angle, the brace 7 being limited in movement by the stop 28 and the base of the slit 39, whereas on the other side the curve (FIG. 4) forces the brace 7 into a horizontal position relative to the fixed member 1 and the opening member 3, the end regions 41 definitively blocking the brace 7 in this position, so that the opening member 3 can no longer be separated from the fixed member 1 except by force.

Although not illustrated here, it can be readily imagined that the opening handle 3 will fold down against the transverse side of the suitcase 2 and the lug 22 will retract; the device will preferably be positioned on the central portion of the lateral face of a suitcase, generally recessed, in such a manner as to fit within the framework of the latter, while the rounded end 42 enables a finger to be inserted beneath the element 5, thus enabling the handle 3 to be opened out.

It would not constitute a departure from the scope of the present invention to apply modifications thereto, notably in the dimensions of the constituent elements, although one characteristic of the invention is the length for the opening handle 3 of approximately 28 cm and the portion intended for receiving the hand of approximately 10 cm, these dimensions being especially favourable for the intended use of the device.

I claim:

1. A handle assembly for a suitcase of rigid structure having a bottom, top, sides and ends and rolling elements at at least one end of the bottom, said handle assembly comprising:

a fixed vertical member of outwardly opening U-shaped channel cross section secured to one end of the suitcase near the top thereof, a handle comprising a member of U-shaped channel cross section pivotally connected at an inner end to an upper end portion of said fixed member for pivotal movement between a closed position in which it is nested with said fixed member and an open position in which it extends approximately perpendicularly from said fixed member, a brace member having an inner end pivotally connected to said fixed vertical member at a point below the pivotal connection of said handle member, and an enlarged outer end slidable in a channel provided in said channel shaped cross-section of said handle member, stop means in said channel for limiting the sliding movement therein of said outer end of said brace member, and a double-curved spring strip secured to said fixed member and engaging said brace member to exert a force thereon to retain said handle member in its closed position when in said closed position and to retain said handle member in its open position when moved to said open position.

2. A handle assembly according to claim 1, in which said brace member is of channel cross-section with an inner end portion flattened and provided with a hole for a pivot pin and with a transverse pin spaced from said hole for engagement by said spring strip.

3. A handle assembly according to claim 2, in which said spring strip has a flat portion which is secured to said fixed member and a free end portion which is bifurcated to straddle said flattened end portion of said brace member and engage opposite end portions of said transverse pin.

4. A handle assembly according to claim 3, in which said bifurcated free end portion of said spring strip is reversely curved to provide a first curved portion engaging said transverse pin to bias said brace member in a direction to hold said handle member in closed position and a second curved portion engaging said transverse pin to bias said brace member to hold said handle member in open position.

5. A handle assembly according to claim 1, in which said fixed member is shorter than said handle member and is received in an inboard portion of said handle member when in its closed position, and in which said handle further includes a molded element which is received in an outboard portion of said handle member of U-shaped cross-section, the combined length of said fixed member and said molded element not exceeding the length of said handle member of channel cross-section.

6. A handle assembly according to claim 5, in which said molded element provides a channel in which said outer end of said brace member is slidable and a stop for limiting movement of said brace member in a direction to open position of said handle.

7. A handle assembly according to claim 5, in which said molded element is provided in an outer end portion with a recess extending perpendicular to said handle member of channel cross-section and in which a retractable lug is received in said recess and is spring biased to a position in which it projects from said molded element to prevent a user's hand from slipping off of said handle.

8. A handle assembly according to claim 5, in which a portion of said molded element is formed with indentations to receive the fingers of a user's hand grasping the handle.

9. A handle assembly according to claim 8, in which said handle has a length of approximately 28 cm and the portion of said molded element provided with said indentations has a length of approximately 10 cm.

* * * * *